US006062176A

United States Patent [19]

Berger

[11] Patent Number: 6,062,176

[45] **Date of Patent: *May 16, 2000**

[54] MULTICYLINDER, TWO-STROKE, RADIAL ENGINE FOR MODEL AIRPLANES AND THE LIKE

[76] Inventor: Lee Berger, 17459 Lilac-Unit G, Hesperia, Calif. 92345

[ * ] Notice: This patent issued on a continued prosecution application filed under 37 CFR 1.53(d), and is subject to the twenty year patent term provisions of 35 U.S.C. 154(a)(2).

[21] Appl. No.: 08/910,137

[22] Filed: Aug. 13, 1997

Related U.S. Application Data

[60] Provisional application No. 60/023,706, Aug. 20, 1996.

[51] Int. Cl.[7] ..... F02B 75/22

[52] U.S. Cl. ..... 123/54.1; 123/54.2

[58] Field of Search ..... 123/54.1, 54.2, 123/55 R

[56] References Cited

U.S. PATENT DOCUMENTS

| | | | |
|---|---|---|---|
| 1,690,144 | 11/1928 | Teasdale | 123/54.2 |
| 1,921,985 | 8/1933 | Moore et al. | 123/54.2 |
| 2,170,151 | 8/1939 | McCarthy | 123/54.2 |
| 2,255,852 | 9/1941 | Lundin | 123/54.2 |
| 2,288,017 | 6/1942 | Neuland | 123/54.2 |
| 2,408,394 | 10/1946 | Guerasimoff | 123/54.2 |
| 2,425,156 | 8/1947 | Knight | 123/54.2 |
| 4,512,291 | 4/1985 | Kirk | 123/54.2 |
| 4,850,313 | 7/1989 | Gibbons | 123/55 R |
| 5,146,880 | 9/1992 | Mayne | 123/54.2 |

*Primary Examiner*—Marguerite McMahon
*Attorney, Agent, or Firm*—Nixon & Vanderhye P.C.

[57] ABSTRACT

A multicylinder, two-stroke, radial, internal combustion engine employs a multi-blade positive-displacement pump for pressurizing a mixture of air/fuel/lubricant supplied to a plurality of cooperating cylinders. One of the pistons is connected to a master connecting rod which bears a plurality of crank pins respectively connected to the connecting rods of the other piston/cylinder assemblies of the multicylinder engine. The exhaust gases from the plurality of cooperating cylinders are collected in a common annular exhaust manifold and quietly emitted therefrom through a single exhaust port in a downward direction. A multibladed, positive-displacement pump draws an air/fuel/lubricant mixture from a carburetor through an annular volute which promotes fuel evaporation and supplies a pressurized intake flow to the cylinders via a single shared crankcase.

3 Claims, 13 Drawing Sheets

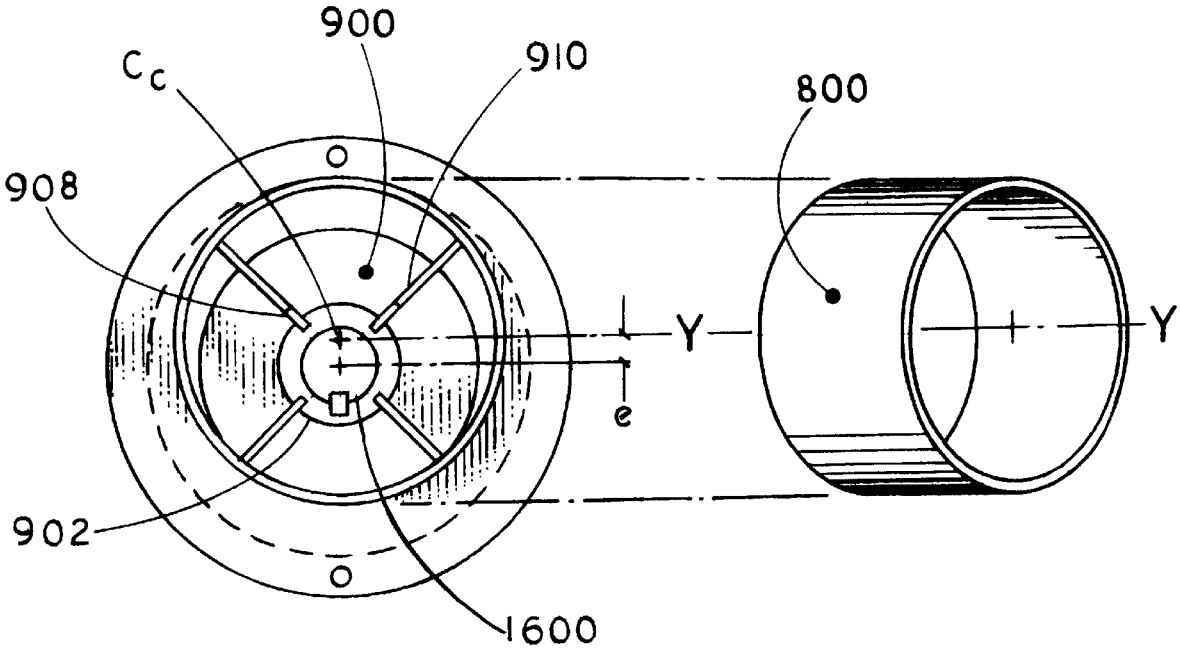
FIG 8(A) FIG 8(B)
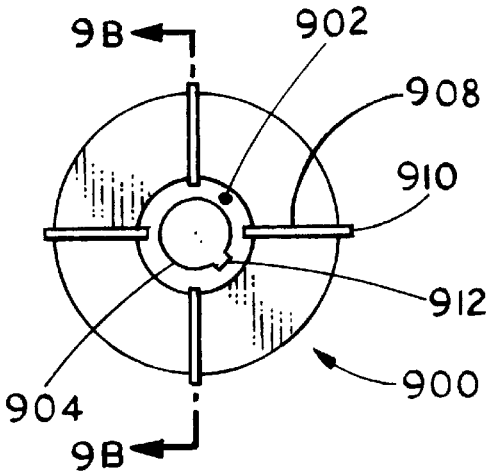
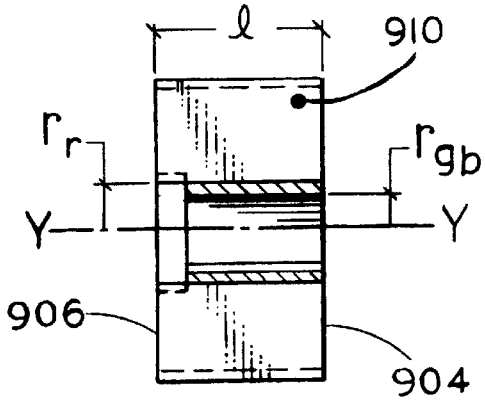
FIG 9(A) FIG 9(B)

FIG 13(A)
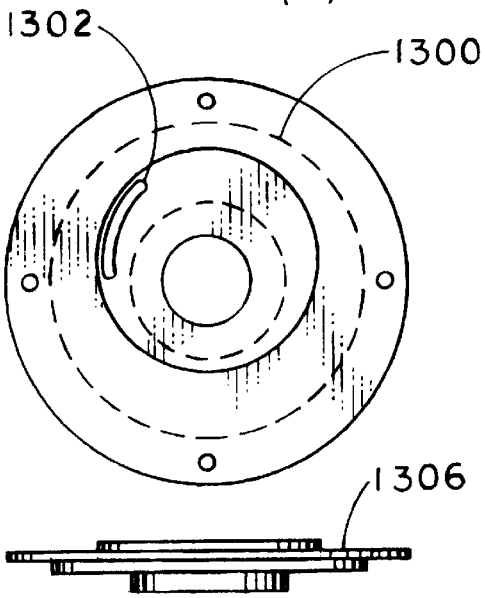
FIG 13(B)
FIG 14(A)
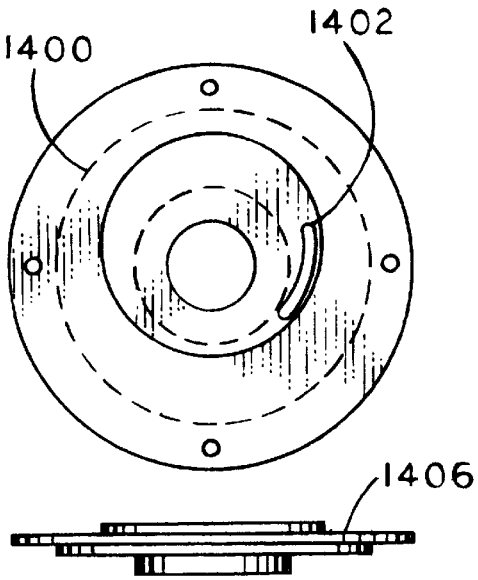
FIG 14(B)
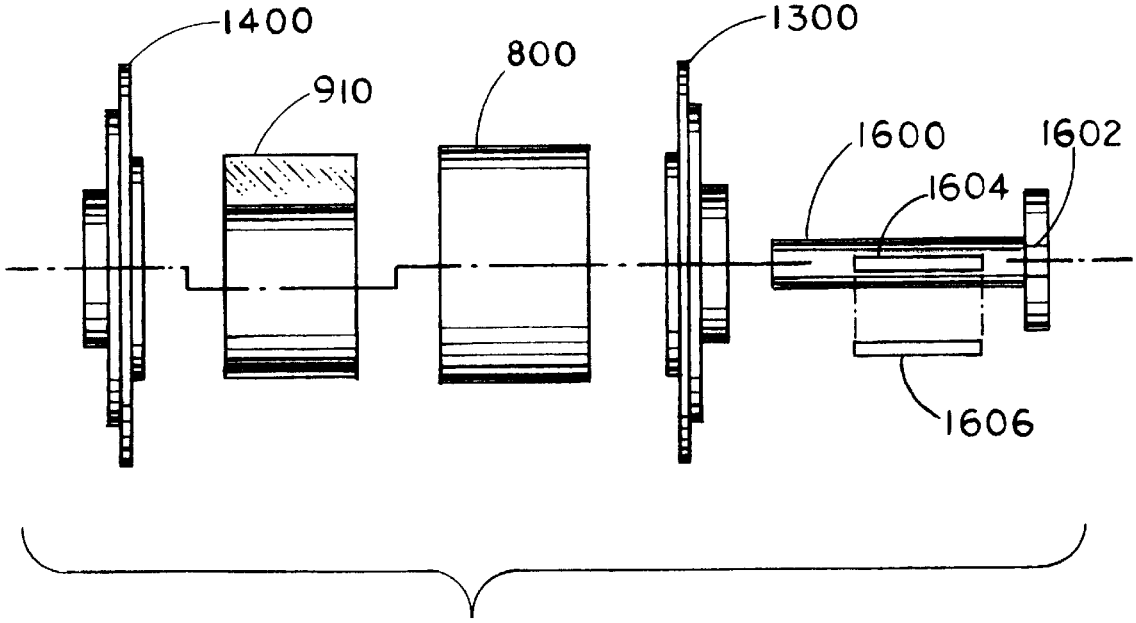
FIG 15

MULTICYLINDER, TWO-STROKE, RADIAL ENGINE FOR MODEL AIRPLANES AND THE LIKE

This application claims priority from provisional patent application Ser. No. 60/023,706, filed Aug. 20, 1996, which is incorporated herein by reference.

FIELD OF THE INVENTION

The present invention is directed to an internal combustion engine, particularly, to a two cycle multi-cylinder internal combustion engine, boasting a common crankcase and a firing order. In a radial configuration of the engine cylinders the firing order is in sequence, 1, 2, 3, 4, etc., according to the number of cylinders used. In the in-line, V or opposed configurations the firing order is determined by the position of respective throws on the crank shaft. The engine is of a type started by applying a voltage from an external source to glow plugs, and the applied voltage is removed once the engine is started. If spark ignition is used the ignition must remain on.

BACKGROUND OF THE RELATED ART

The hobby of making and flying high-performance realistic models of airplanes is very popular in the United States and elsewhere. Such model aircraft typically are radio-controlled, can be made to perform impressive maneuvers and stunts, and are propelled by wood, metal or composite material propellers driven by two-stroke or four-stroke internal combustion engines.

For many years modellers with machining abilities have tried to develop a true two-cycle multi-cylinder engine, sharing a common crankcase by using known art. Although some of the engines ran, the energy used to charge the crankcase left little energy to drive the propeller. These engines were impractical and unacceptable.

A typical two-stroke engine is one in which each complete rotation of a rotatable crankshaft corresponds to two strokes (one forward, one back) of a reciprocating piston connected to the crankshaft by a connecting rod, with one power stroke for every complete rotation of the crankshaft. A simple four-stroke engine also employs a piston and a connecting rod to rotate a crankshaft, but there is only one power stroke for every two complete rotations of the crankshaft. For the same size/weight, the two-stroke engine generates a higher power output than a four-stroke engine and is therefore sometimes preferred.

A multicylinder four-stroke engine may have a plurality of cylinders in-line, in a V-arrangement, opposed, or in a radial array relative to a common crankshaft axis. Each cylinder and piston arrangement requires respective intake and exhaust valves, and associated shared camshafts or the like to operate the valves in specific sequences. A single carburetor is typically employed, especially for a small engine, to provide a controlled mixture of air, fuel and oil to the cylinders. Lubrication for the moving parts in a four-stroke engine is typically provided by blow-by, i.e., by residual oil in the cylinders which passes by the piston into the crankcase, or by a sump providing oil for internal lubrication. In the radial configuration, when the engine stops the lower cylinders collect the oil from the crankcase. This requires the removal of the lower plugs, to prevent fouling of the plugs and hydrostatic lock.

A two-stroke engine, by contrast, typically has only one cylinder driving one rotatable crankshaft substantially encased within a crankcase. A mixture of vaporized fuel, air, and a lubricant in the form of very fine droplets is contained in the crankcase under pressure produced by the piston traveling downward into the crankcase. During the "down" stroke the piston passes the exhaust port, expelling the exhaust of the previous cycle. The piston upon traveling further downward a very short distance exposes a valveless intake port. The Pressurized fuel, oil, air mixture passes from the crankcase into the top of the cylinder, replacing the exhaust gas which continues to pass out of the exhaust port. On the second or "up" stroke the piston passes the intake and exhaust ports, sealing them from the crankcase. A vacuum is thus created in the crankcase while, simultaneously, a pressure is being created at the top of the cylinder. Fresh air/fuel mixture enters the crankcase through a carburetor and, as the piston reaches top dead center (TDC), an ignition source fires the compressed air/fuel mixture, generating a power stroke during which compressed products of combustion force the piston to make a working or power stroke. The connecting rod and the connected crankshaft thus are moved into their respective power-producing motions.

Although it is possible to have two two-cycle cylinder assemblies in a single crankcase, both pistons must reach top dead center at the same time and must also travel downward at the same time in order to create the pressure and vacuum necessary to operate the engine. This need to continually generate vacuum to draw fuel/air/lubricant mixture into the crankcase and generate compression needed to charge the cylinders is why multi-cylinder two cycle engines with a firing order, i.e., where each cylinder fires independently and alternately of the others, are not known.

It is well-known in the mechanical engineering arts that a two-stroke engine has fewer parts, needs little or no maintenance, and provides a higher power-to-weight ratio than does a comparably sized four-stroke engine.

The now historic great aircraft of "World War One" and "World War Two" and many commercial and private aircraft used radial engines. Even today, some aerobatic aircraft use radial engines. There has, therefore, for a long time existed a strongly felt need among model aircraft enthusiasts and the like for a multi-cylinder two-stroke engine which would be affordable, simple to operate, light in weight, relatively quiet, and capable of providing a high power to weight ratio. Serious modellers take great pains to ensure realism when building scale models and seek such a power source to enhance the realism and performance of their aircraft.

The present invention is intended to meet all of these needs, and differs in many significant respects from what is known in the prior art.

Thus, for example, U.S. Pat. No. 4,957,072, to Goldowsky, titled, "Balanced Radial Engine", provides a multicylinder radial aircraft engine in which an even number of individual single-cylinder, slider crank, two-stroke engines operate in opposed pairs in an integrated assembly. The outputs of the individual engines cooperatively drive a central common crankshaft via gears, but each engine obtains its air/fuel/lubricant mixture from its own individual crankcase. The disclosed composite engine, therefore, is really only an assembly of single-cylinder, two-stroke engines each with its own crankcase positioned to be radial in its individual (not common) plane about the rotation axis of the shared power-delivering crankshaft.

U.S. Pat. No. 5, 150,670, to Sadler, titled "Radial Internal Combustion Engine", teaches a four-stroke engine in which a plurality of paired rows of cylinders are disposed in respective common planes and the corresponding reciprocating pistons move within the cylinders to drive a common crankshaft.

U.S. Pat. No. 2,671,983, to Roehrl, titled "Toy Airplane", teaches a plastic toy airplane structure having ground contactable wheels. A child playing with the toy may move it in contact with a floor to drive, via gearing, a master connecting rod snap-fitted by a C-shaped slot to the crank pin of a crankshaft in a transparent plastic motor which allows the child to see the drive to a plastic propeller. The master connecting rod is connected to a piston and, via other C-shaped slots, is fitted to a plurality of other connecting rods which move respective pistons inside corresponding cylinders radially of the crankshaft axis. This, obviously, is merely a toy and the patent does not teach a functioning common crankcase or the like in a power-producing engine.

U.S. Pat. No. 2,312,661, to Messner, titled "Supercharger for Model Motors", teaches a fixed vane, friction-driven, rotating supercharger to improve combustion in a small internal combustion engine suitable for a model aircraft. The type of supercharger disclosed in this reference, while it may improve the power output and/or efficiency of a given single-cylinder engine, cannot provide an airflow and pressure augmentation that would be adequate for a multicylinder two-stroke engine.

U.S. Pat. No. 2,463,933, to Adkins, titled "Supercharging the Crankcase of Two-Cycle Engines", teaches a supercharger in which a slotted rotor holds a movable vane having an outer edge sliding along an eccentrically centered wall of a supercharger housing to provide pressure augmentation in a single-cylinder two-stroke engine. The inside end of the vane is spring-biased against a base of the slot within which the vane slides with its outer edge biased to maintain contact with the internal surface of a housing.

Thus, although there is considerable prior art relating to two- and four-stroke engines, etc., none is considered any more relevant to the present invention than the art discussed above.

SUMMARY OF THE INVENTION

A principal object of the present invention is to provide a multicylinder, two-stroke, radial internal combustion engine, of a type suitable for powering small aircraft.

A related object of this invention is to provide a quiet, lightweight, multicylinder, two-stroke, radial internal combustion engine for providing a rotational output.

Another object of this invention to provide aircraft modellers a true radial engine, which requires practically no maintenance, has an acceptable weight to power ratio, and provides output power nearly that of a single cylinder engine of the same volumetric displacement at an affordable price.

According to another aspect of this invention it is a principal object to provide an intake pressurizer pump, with internal pressure-promoted biasing of displacement vanes, particularly suitable for compressing a mixture of air/fuel/lubricant for a multicylinder two-stroke engine.

According to yet another aspect of this invention, a principal object is to provide an eccentric connecting rod mechanism for driving a single rotational output crankshaft with inputs from a plurality of radially-reciprocating pistons in a multicylinder, radial, two-stroke internal combustion engine.

According to yet another aspect of this invention it is a principal object to provide an exceptionally quiet exhaust outflow system simultaneously serving to convey exhaust from a plurality of radially-oriented cylinders in a multicylinder, two-stroke, radial internal combustion engine.

According to yet another aspect of this invention there is provided a propeller-type propulsion system, including a multicylinder radial engine, for a small aircraft.

These and other related objects are realized by providing in a preferred embodiment of this invention a multicylinder, two-stroke, radial, internal combustion engine which includes a plurality of engine cylinders with their respective axes in a single plane evenly spaced apart angularly about a rotation axis of a crank. Each cylinder is provided with an intake port and an exhaust port and contains a piston reciprocating therein, the cylinders being "fired" in sequential order. A plurality of connecting rods is included, with each having a piston end pivotably connected to a corresponding one of the pistons. A crank drive element is irrotatably fixed to one of the connecting rods. The crank drive element is provided on one side with a plurality of cantilevered crank pivot pins for pivotably mounting the other connecting rods thereat in a secure but readily separable manner. The crank drive element has a central aperture to receive a first end of the crank to engage and drive the crank around the common crank rotation axis. The sequential firing of the cylinders ensures that the piston in each cylinder is still moving in its power-delivering motion as the next cylinder fires, thus ensuring smooth operation with high torque.

In another aspect of this invention there is provided an apparatus for pressurizing an intake flow of air/fuel/lubricant for a multicylinder, two-stroke, internal combustion engine via a shared crankcase thereof, the apparatus having a chamber with a cylindrical peripheral surface extending along a first axis between two opposed chamber end surfaces. At least one of the two chamber end surfaces is formed to have a central annular recess having an outer radius. A rotor inside the chamber has a cylindrical rotor peripheral surface extending between two opposed rotor end surfaces, and is supported to be rotatable about a second axis parallel to but offset with respect to the first axis by a predetermined eccentricity. The rotor end surfaces are each separated from an adjacent one of the chamber end surfaces by a lubricated clearance. A plurality of radial slots is formed in the rotor to extend inwardly of the rotor peripheral surface each to a base located at a base radius relative to the second axis, each slot extending through the two end surfaces of the rotor. The eccentricity and the base radius are selected such that a bottom portion of each of the slots is in constant communication with respective bottom portions of all other slots via the annular recess in the chamber end wall. A plurality of blades is provided to fit slidingly in respective slots of the rotor, each blade having edges in sliding contact with adjacent surfaces of the chamber.

According to yet another aspect of this invention, there is provided a multicylinder radial internal combustion engine in which a plurality of engine cylinders are uniformly distributed about a rotation axis of a crank with their respective axes in a single plane, each cylinder having an intake port and an exhaust port and containing a piston reciprocating therein in a two-stroke operation, a plurality of connecting rods each having a piston end pivotably connected to a corresponding one of the pistons. A crank drive element is irrotatably fixed to one of the connecting rods. This crank drive element is provided on one side with a plurality of cantilevered crank pivot pins for pivotably mounting the other connecting rods respectively thereat. The crank drive element has a central aperture to receive a first end of the crank to drive the crank around the common crank rotation axis.

In an even further aspect of this invention, for a multicylinder, two-stroke, radial, internal combustion engine, in which the engine cylinders have respective axes oriented radially in a single plane orthogonal to an engine axis, wherein all the cylinders receive a pressurized mixture of air/fuel/lubricant from a commonly shared crank case and each cylinder has a mixture intake port and an exhaust port, there is provided a single annular exhaust collector ring and muffler which communicates with each of the exhaust ports and has a single exhaust outflow opening located in a bottom portion to direct a collected exhaust outflow downward during a substantial portion of the time that the engine is in use.

Even further, a propeller-type propulsion system is provided for an aircraft, and includes a plurality of cylinders having respective axes evenly spaced apart angularly in a single plane perpendicular to a first axis. A plurality of pistons is provided, these reciprocating in respective cylinders in a two-stroke operation. A master connecting rod has a piston end pivotably connected to a first of the pistons and rigidly connected to a first crank end provided with a plurality of crank pins. Additional connecting rods, each respectively connected pivotably to a corresponding piston at a respective piston end are pivotably connected to respective crank pins at a corresponding crank end. Also included is a crank having a torque input end to deliver an output torque, and is rotatable about the first axis. An aperture is provided in the master connecting rod to receive therein the torque input end of the crank to rotate the crank about the first axis. A propeller is rotated by the crank output torque to generate a propulsive force for the aircraft.

These and other related aspects of this invention will be better understood with reference to the following detailed description and the appended drawing figures.

BRIEF DESCRIPTION OF THE DRAWING

FIGS. 8(A) is an end view of the charging unit, with rear cover removed, showing operational positions of the internal parts, and the offset center of the cylindrical housing; and FIG. 8(B) is a perspective view of the cylindrical steel tube charging unit housing.

FIGS. 9(A) and 9(B) are an end elevation view and a transverse cross-sectional view, respectively, of an engine rotor and pump blades assembly of a type rotated within the cylindrical casing per FIGS. 8(A) and 8(B) to pressurize an air/fuel/lubricant flow from a carburetor into the shared engine crankcase, showing the annular chamber connecting all four vane slots.

FIG. 13(A) is an inside plan view of the rear cover plate of the charging unit, and FIG. 13(B) is a side elevation view thereof.

FIGS. 14(A) and 14(B) are a plan view and side elevation view, respectively, of one of the similar front cover plate.

FIG. 15 is an axial, exploded view of the crankcase charging unit.

It is to be noted that the appended drawings illustrate only preferred embodiments of this invention and are therefore not to be considered limiting of its scope, for the invention may admit other equally effective embodiments.

DETAILED DESCRIPTION OF THE PREFERRED EMBODIMENTS

The following description focuses on a preferred embodiment of this invention as utilized to rotate a multi-bladed propeller of an airplane. With obvious but non-critical modifications, which persons of ordinary skill in the art should be able to make readily, such an engine can be employed with another engine to propel a twin-engine model, or used by itself to propel a drone airplane or a photo-reconnaissance airplane.

The following description, therefore, focuses principally on those structural and functional features of the engine which provide certain singular benefits.

Figure 1:
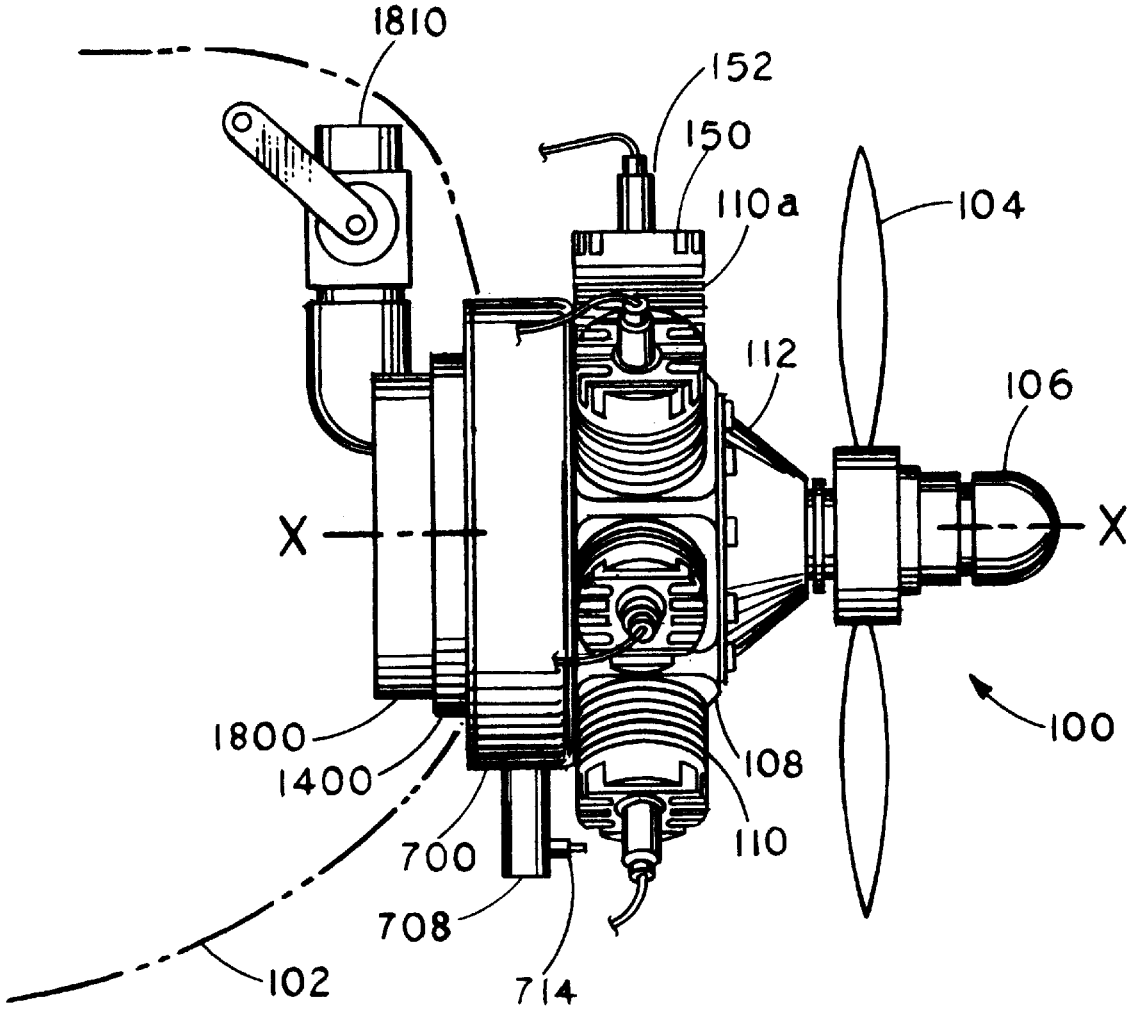
FIG. 1 is a side elevation view of an exemplary seven-cylinder, two-stroke, radial engine according to a preferred embodiment of this invention, provided with a conventional propeller.

As best seen in FIG. 1, such an exemplary engine 100 having seven cylinders may be mounted in conventional manner to the front of the fuselage of an aircraft 102 (shown in chain lines) Typically, the rotational output of the engine crankshaft is utilized to directly rotate a propeller 104 mounted at the front end of the engine crankshaft and retained thereat by a hub 106. A rear portion of the engine structure is preferably located within the fuselage 102 together with ancillary elements such as a fuel tank, a battery, radio control elements, etc.

A principal portion of engine 100, as best seen in FIG. 1, is a shared crankcase body 108 to the outside of which are mounted a number of engine cylinders 110 with their respective axes oriented radially of the crankshaft axis X—X.

Crankcase body 108 is formed to a size and an internal/external configuration such that a plurality of individual engine cylinders 110 may be securely mounted thereto. All of the engine cylinders 110 have their axes in a single plane perpendicular to the crankshaft axis.

Figure 2:
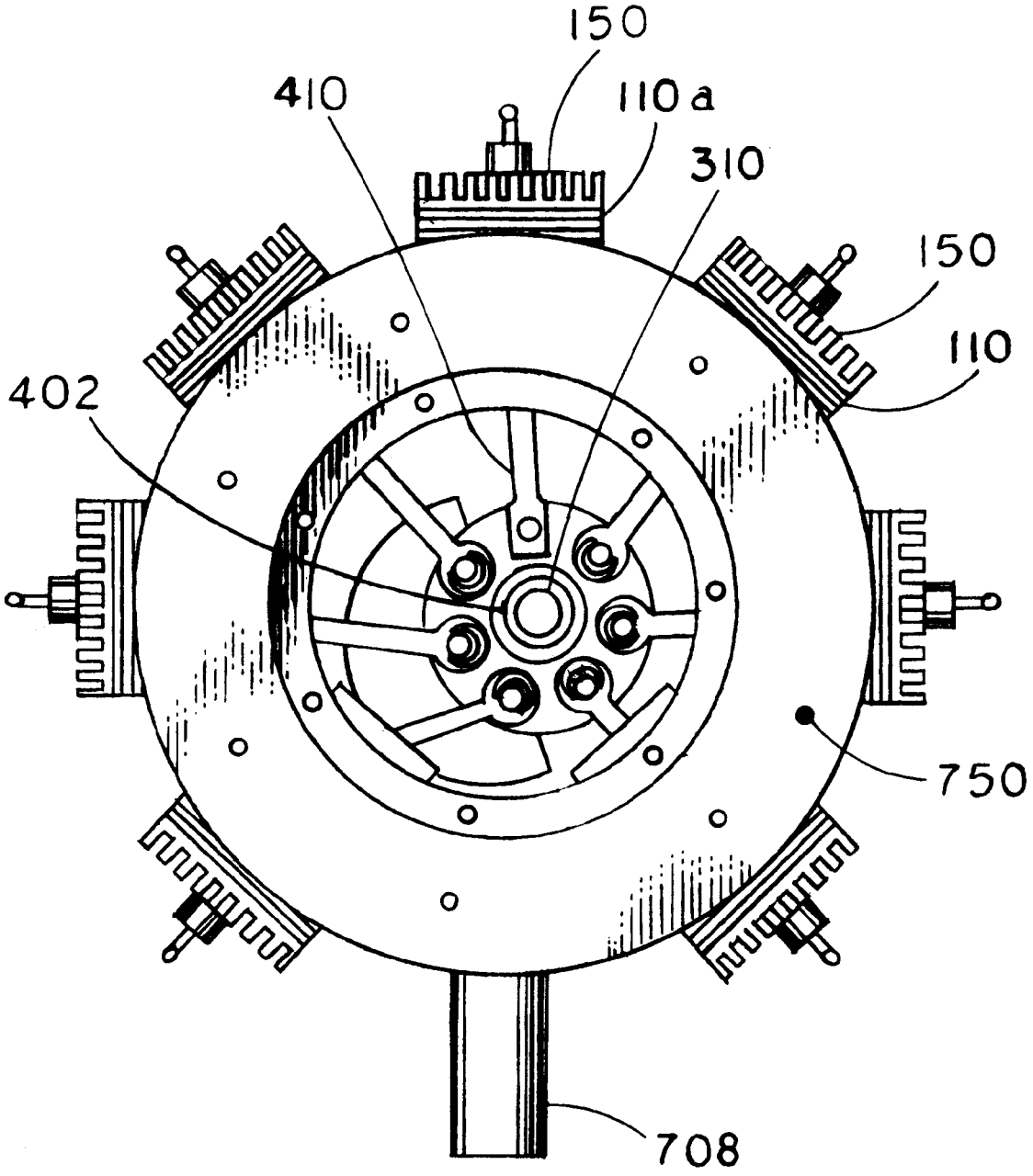
FIG. 2 is a partial perspective rear view of the engine with the crank case charging unit removed to enable viewing of internal components.
Figure 3:
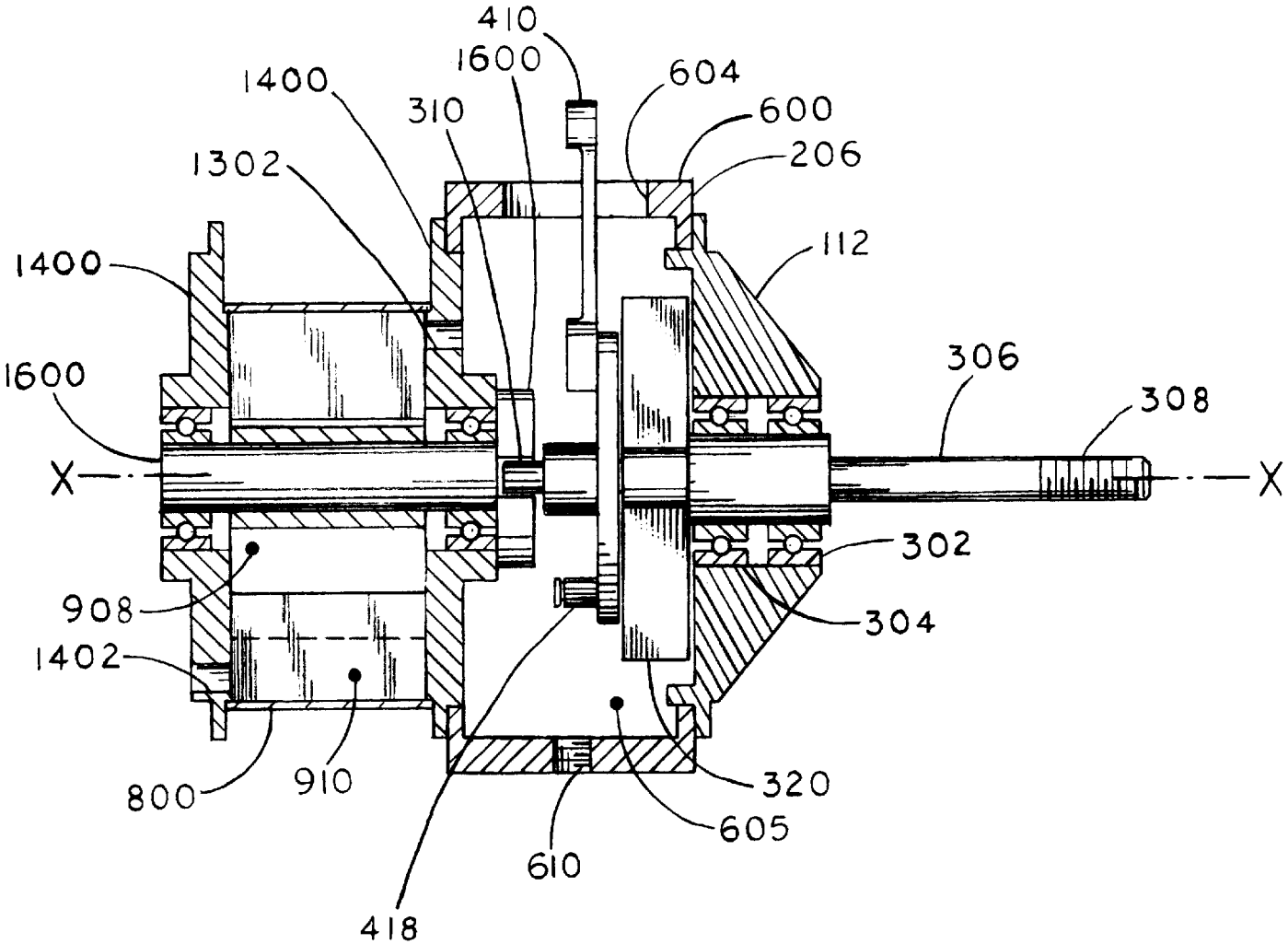
FIG. 3 is a longitudinal partial cross-sectional view of the engine according to FIG. 1, with the crankcase charging unit attached.

As best seen in FIGS. 2 and 3, the rear of crankcase body 108 presents a plane annular surface 204 into which are provided a plurality of threaded holes 204*a*. Crankcase body 600 has the general form of an annular open-ended cylinder having a front annular surface 206 generally similar to rear annular surface 204. The peripheral surface of engine body 108 is provided with a plurality of external plane portions 602 (seven in the engine per FIG. 1) to which the respective bottoms of engine cylinders 110 are mounted. Note that for convenience of reference the uppermost engine cylinder is identified as "110*a*".

Front cover 112 supports conventional shaft bearings 302, 304 to rotatably support crankshaft 306 which is rotatable about a longitudinal axis X—X and is preferably provided with a threaded front end portion 308 to which hub 106 is applied to affix propeller 104 (not shown in FIG. 3). Crankshaft 306 is provided with a crank end 310 which extends through a center aperture 402 of a crankdrive element 416, best seen in FIG. 4.

A single piston 404 will reciprocate in each of engine cylinders 110*a*, 110. Each engine cylinder has a respective cylinder head 150 provided with a glowplug 152 connected to a conventional multiple ignition system of known kind. Numerous such systems are commercially available.

In one embodiment, the piston 404*a* reciprocating in the uppermost engine cylinder 110*a* is pivotably connected at a piston pin 406*a* to a unique master connecting rod 410. Each of the other pistons 404 is respectively connected to a piston pin 406 pivotably connected to a connecting rod 408. Master connecting rod 410, as best seen in FIGS. 2, 3 and 4, has its lower end 412 irrotatably affixed, e.g., cast, brazed or welded, at 414 to a preferably circular crankdrive element 416 which has a central aperture 402 sized to rotatably receive therein crankend 310 extended therethrough.

Figure 5C:
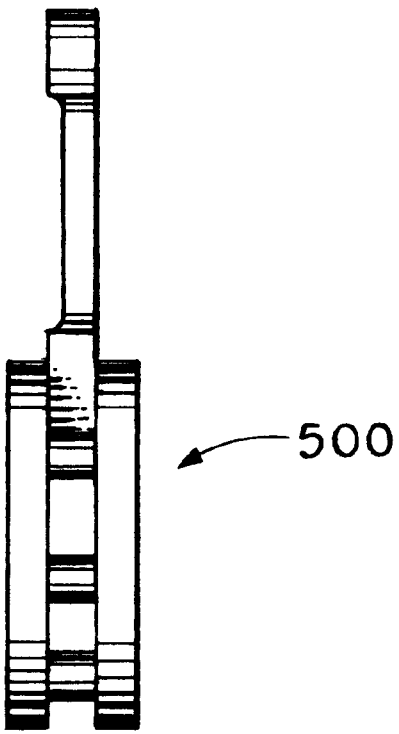
FIG. 5(C) is a side elevation view of a master rod assembly used in conventional four-stroke radial engines.
Figure 5B:
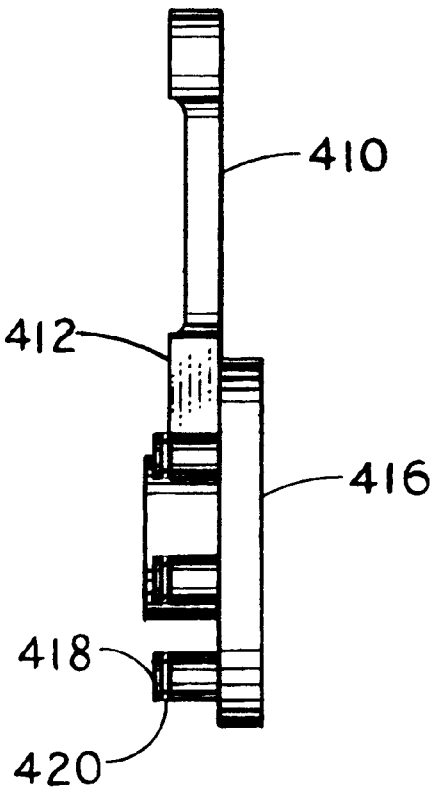
FIGS. 5(A) and 5(B) are front and side elevation views, respectively, of the master rod of the unique crank system according to this invention.
Figure 5A:
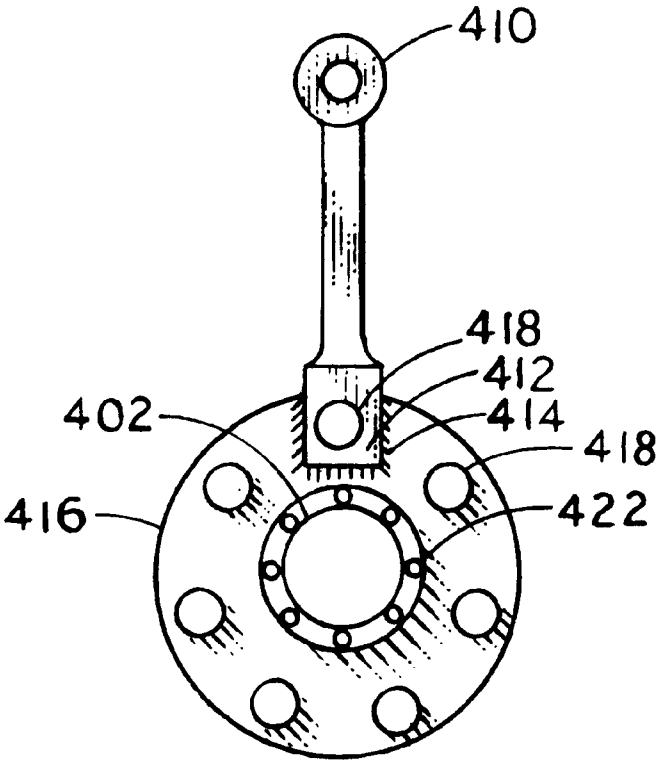

FIGS. 5(A) and 5(B) are front and side elevation views, respectively, of master rod 410. As best seen in FIG. 5(A), on the side where master connecting rod 410 is irrotatably affixed to crankdrive element 416, there is provided a plurality of cantilevered crank pins 418. In the exemplary best mode of the engine, there are seven evenly spaced cylinders and, therefore, a total of seven evenly spaced crank pins 418, one of which passes into the lower end 412 of master connecting rod 410.

Figure 4:
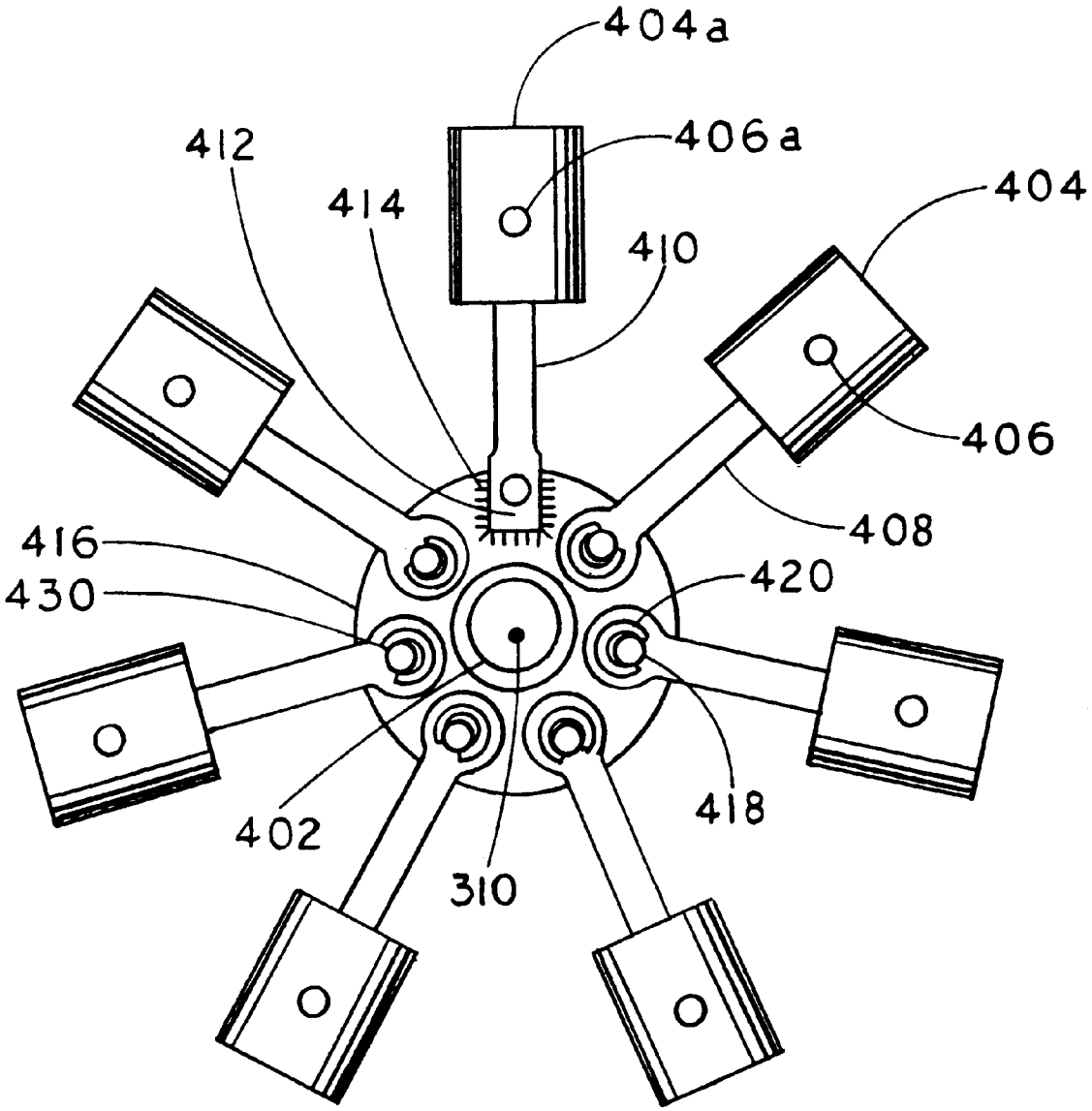
FIG. 4 is a rear elevation view of the pistons, wrist pins, and master rod assembly with one fixed and six pivotable connecting rods of the engine according to FIG. 1.

Note that each crank pin 418 is provided a peripheral groove 420 to which may be applied a conventional retaining clip 430 which retains a corresponding end of the connecting rod 408, as best understood with reference to FIG. 4.

Accordingly, the crank assembly of this invention, when the pistons are fired sequentially either clockwise or counterclockwise, provides a plurality of piston forces consecutively pushing on the crank pin or journal received within aperture 402 to provide an eccentric drive to rotate crankshaft 306 about axis X—X. FIG. 5(C) shows an example of a master rod assembly 500 used in a four-stroke radial engine.

A significant advantage of the crank system according to the present system is that removal of any single retaining clip 430 in conventional manner permits the easy disassembly of the corresponding connecting rod and piston once the corresponding engine cylinder 110 has been unbolted and removed from the common crankcase. Thus, if there is any damage experienced by that particular engine cylinder 110, piston 404, piston pin 406 or connecting rod 408, the damaged element may be readily replaced without requiring difficult and time-consuming disassembly of the other comparable elements. By contrast, in the known crank system 500 shown in FIG. 5(C), the entire master rod assembly would need to be removed and this would require significant investment of time and effort to take apart virtually the entire engine. This is a significant problem with radial engines.

The crank system according to this invention, in short, has a structure which is relatively light in weight, short in length, simple to manufacture, and one which lends itself to easy maintenance for the reasons just described. As noted earlier, and as will be readily appreciated by persons of ordinary skill in the mechanical arts, when the individual pistons reciprocate in their respective cylinders, crankdrive element 416 will simply orbit in a circular manner relative to crank rotation axis X—X, and crank end 310 which projects through the central aperture 402 of crank drive element 416 will transmit a rotational torque corresponding to the thrust generated by the cooperating set of pistons. If desired, central aperture 402 of crankdrive element 416 may be defined within a suitably sized conventional roller bearing 422 as best seen in FIG. 5(A).

It was customary in earlier times to have odd numbers of engine cylinders in multicylinder, four-stroke, radial, internal combustion engines. In the exemplary embodiment illustrated in the figures discussed above, there is therefore provided an odd number, i.e., 7, of pistons, engine cylinders, and corresponding elements. This is intended to allow the model airplane enthusiast to produce a realistic replica in modeling older multicylinder four-stroke engines used in early propeller-driven aircraft.

The actual number of cylinders thus provided is not critical, and neither is it critical that an odd number of engine cylinders be employed.

An interesting and unique advantage of the above-described structure, by which a plurality of radially-reciprocating pistons cooperatively torque a crankshaft, is that no complex lubrication system is required. Reference to FIG. 3 clearly shows how the commonly shared crankcase 600 accommodates crankdrive element 416 and the various pivotably connected connecting rods 408 so that the presence of an air/fuel/lubricant mixture within the crankcase 600 effectively lubricates all of these elements while the engine is in operation. No separate lubricant pump, container, or the like is therefore required as is common in four-stroke engines. This, together with the fact that a two-stroke engine has a power stroke for each rotation of the crankshaft, results in a significant saving in engine weight and correspondingly increases the power/weight ratio of this multicylinder, radial, two-stroke, internal combustion engine.

Figure 6C:
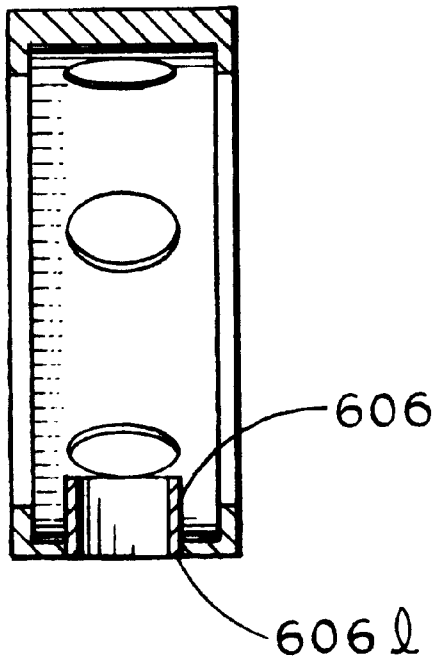
FIG. 6(C) is a cross-sectional view of the crankcase body of FIG. 6(A) at Section C—C.
Figure 6B:
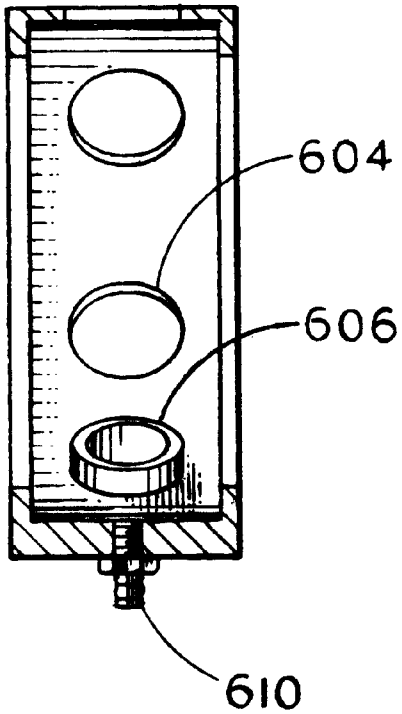
FIG. 6(B) is a vertical cross-sectional view of the crankcase body at Section B—B.
Figure 6A:
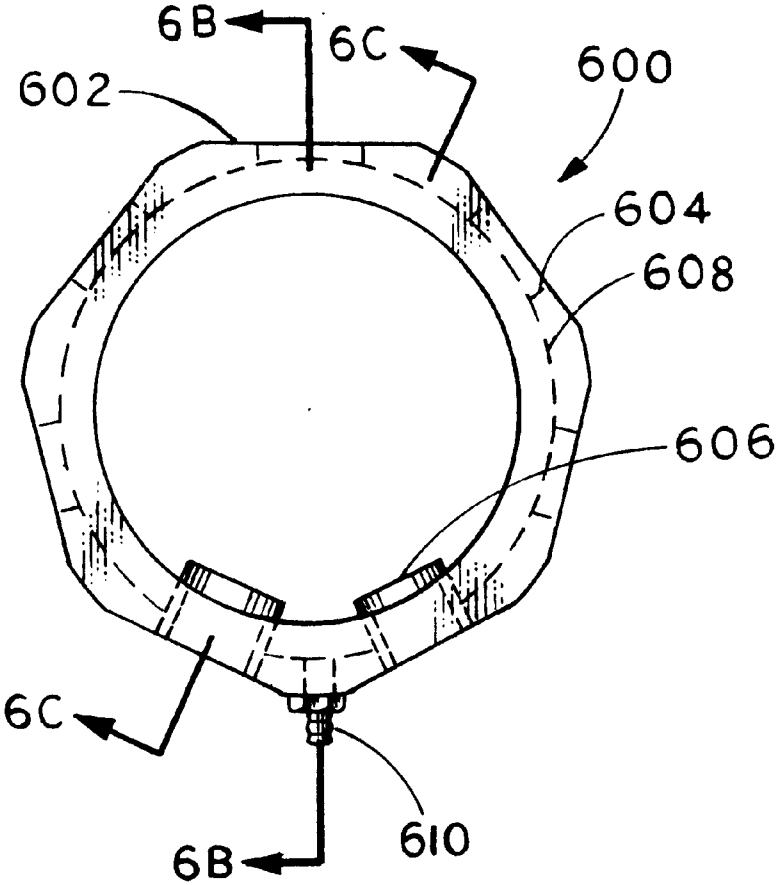
FIG. 6(A) is an end elevation view of the crankcase body of the engine per FIG. 1, showing oil-diverting sleeves and one oil drain hole.

Referring now to FIGS. 6(A), 6(B) and 6(C), it will be seen how shared common crankcase 600 has an outside surface provided with a plurality of plane portions or flats 602 corresponding to the number of engine cylinders employed. Each flat provides a base for a corresponding bottom plane of an engine cylinder 110 which is bolted to the crankcase by conventional small bolts (not shown). Each flat 602 is also provided with an aperture 604 through which a connecting rod 408 or 410 projects to be connected to a corresponding piston 404 which reciprocates within the corresponding engine cylinder 110.

The fuel mixture that enters the cylinder openings 604 enters the cylinders to produce the power to operate the engine. However, lubricant contained in the fuel mixture that comes in contact with the hot crank case housing is separated. The fuel vapor mixes with the incoming mixture and the separated oil being heavier is contained within the annular crankcase 600 and flows to the bottom of the engine directed around the diverting sleeves 606 and exits through a metered fitting screwed into a threaded hole 610 directed through a hose fitted to tube 714 fitted into the exhaust pipe 708, thereby eliminating any oil fouling of the lower plugs and preventing hydrostatic lock. If the lubricant were allowed to run into the two lowermost apertures $\mathbf{604}_1$, $\mathbf{604}_1$, the corresponding lowermost engine cylinders 110, 110 may become partially filled with liquid lubricant and this would have a deleterious effect on the performance of the engine when it is restarted. To avoid this problem, through each of apertures 604, there projects radially inward a short cylindrical stub 606. These two stubs 606, 606 serve to keep any condensed liquid lubricant material from entering the lowermost apertures $\mathbf{604}_1$, $\mathbf{604}_1$. An annular cup 608 is machined into the crankcase to reduce weight and direct oil to the lower crankcase.

Thus, whether engine is running or not, the excess lubricant oil travels downward through opening 610, metered fitting 612, and tubing to 714 and out the lower end of exhaust 708 thus leaving the aircraft clean of oil.

Figure 7B:
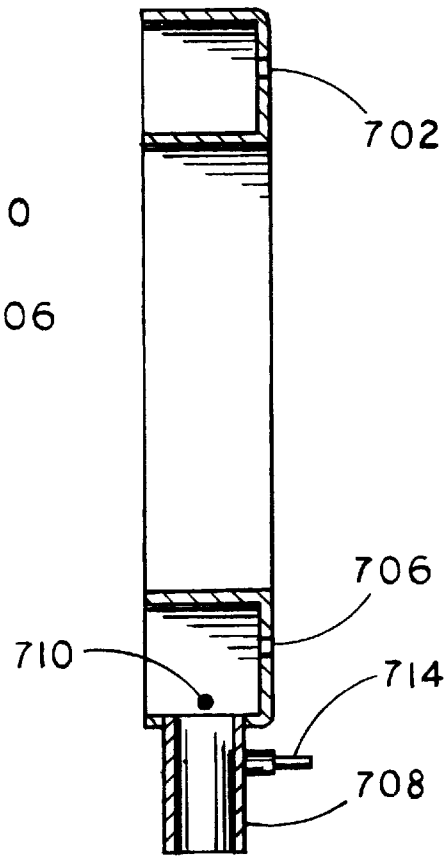
FIGS. 7(A) and 7(B) are end elevation and axial cross-sectional views, respectively, of an integrated exhaust collector ring and muffler suitable for use with the engine per FIG. 1.
Figure 7A:
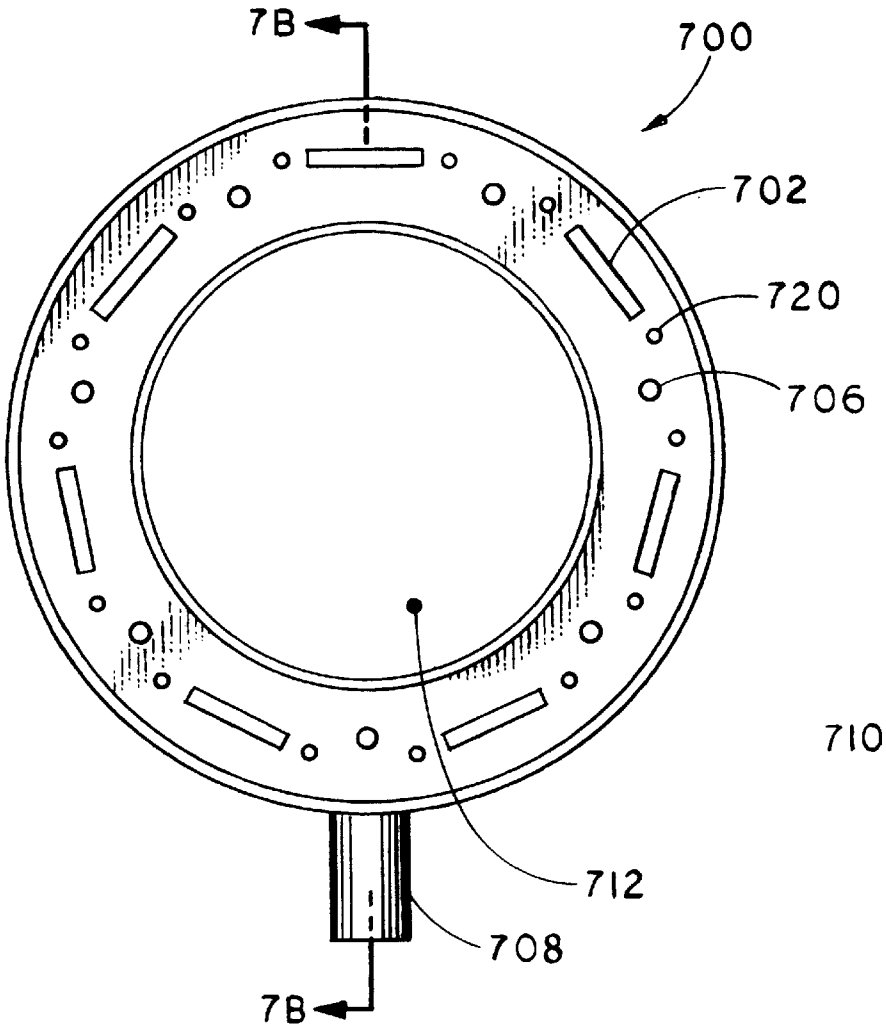
Figure 7D:
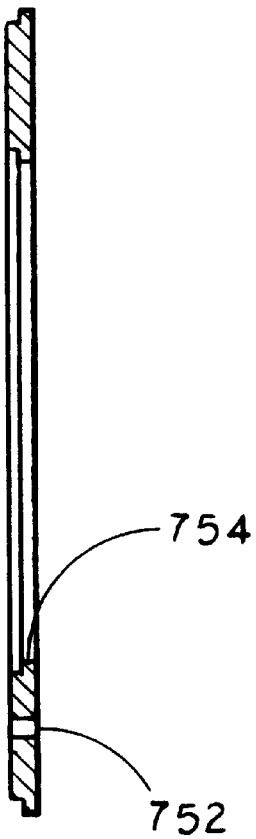
FIGS. 7(C) and 7(D) are end elevation and axial cross-sectional views, respectively, of an exhaust cover to be fitted thereto.
Figure 7C:
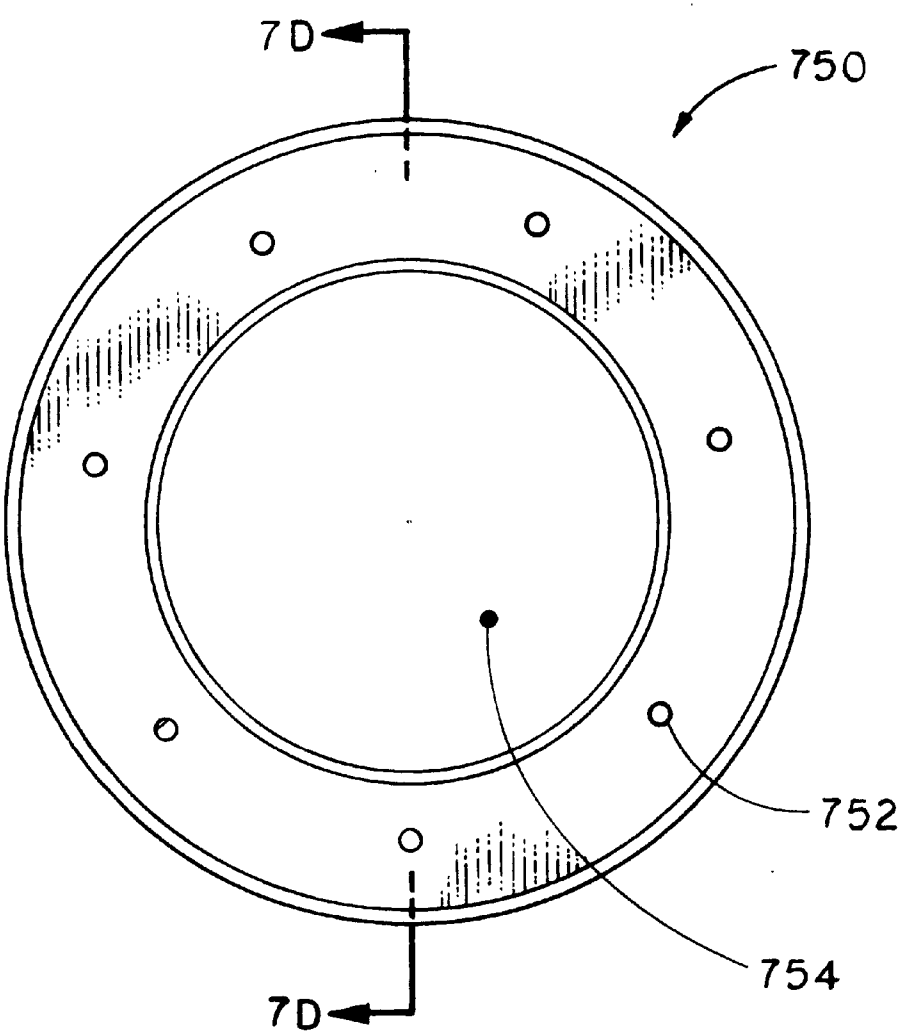

Each of the engine cylinders 110 has a conventional valveless exhaust port (not shown). Because of the circular symmetry about crank axis X—X, the exhaust ports of the different engine cylinders all lie in a single plane and on a common circumference centered on axis X—X. Since an important object of this invention is to provide a multicylinder, two-stroke, radial engine which is relatively quiet, with the above-described crankcase and engine cylinder assembly there is provided a single ring-like exhaust collection and muffler element 700. This is best seen in end elevation and axial cross-sectional views in FIGS. 7(A) and 7(B) respectively.

Exhaust collection ring and muffler element 700 has a generally C-cross-section with a preferably flat, annular, end surface provided with plurality of exhaust-receiving ports 702 sized, spaced-apart and located to simultaneously fit to corresponding exhaust ports of the engine cylinders 110. Interspersed among and between adjacent exhaust-receiving ports 702 are pairs of bolt-receiving apertures 720, 720 through which suitably sized bolts are employed to connect exhaust collection ring and muffler element 700 to all of the engine cylinders 110 simultaneously. Reference may be had to FIG. 1 to see how the engine cylinders 110 each thus are connected to a flat, annular surface 706 of element 700.

It is necessary to close the otherwise annular open portion of element 700, and this is done by suitably sized annular T-cross-sectioned exhaust cover 750 which is sized so that the stem part of the T-shape closely fits into the annular opening of element 700. Element 700 is provided with a second set of bolt-receiving holes 706, and exhaust cover 750 is provided with a matchingly sized and disposed set of bolt holes 752 through which suitably sized bolts which are passed to sealingly engage element 700 and exhaust cover 750 to each other. There is thereby created an annular passage communicating with the exhaust ports of the various engine cylinders to collect individual quantities of exhaust emitted therefrom per rotation of the crankshaft.

Exhaust collection and muffler element 700 is provided with an exhaust pipe 708 located at its lowest point (as determined when the engine is mounted to the model airplane at rest), which has an internal diameter sized to pass therethrough the muffled exhaust from the sequentially-fired engine cylinders during operation at all foreseeable speeds. In other words, opening 710 and the volume enclosed in the annular space defined between exhaust cover 752 and the inside of C-cross-sectioned element 700 cooperate to muffle virtually the sound of the individual exhausts received from cylinders 110. The collected exhaust passes downward through exhaust pipe 708. The central opening 712 defined within element 700, and the corresponding central opening 754 defined in exhaust cover 750, are both sized to fit around an air/fuel/lubricant pump element to be described below.

In the typical single cylinder two-stroke engine a carburetor provides a predetermined air/fuel/lubricant mixture into a relatively small-volume crankcase. Then, when the single piston moves to its BDC this mixture is compressed and, once the engine cylinder intake port is opened by passage of the piston past it, compressed air/fuel/lubricant mixture enters the cylinder as exhaust gases are driven out through an exhaust port opened simultaneously. In the engine according to this invention, there is a single common crankcase shared by all of the engine cylinders. It is, therefore, desirable to form the correct air/fuel/lubricant mixture and to then pump it into the shared common crankcase so that it is available for each engine cylinder as and when needed. Experience with pumping systems for different types of equipment leads to the conclusion that a sliding/vane rotor pump is most suitable.

In the typical sliding/vane rotor pump, there is a generally cylindrical rotor with a plurality of radially oriented slots in a diametral plane of the rotor. Each of these slots slidingly contains a rotor vane which, because the rotor is eccentrically mounted relative to an axis of a cylindrical casing, moves in and out of the slot as the rotor is turned about its own rotational axis. Rotation of the pump rotor generates a centrifugal force which, combined with the freedom of each vane to slide in a lubricated manner within the slot, will cause the outside edge of each blade to rub lubricatedly along the inner surface of the cylindrical casing. Such casings typically are given flat end surfaces and the rotor blades are sized so that they lubricatedly rub against the end surfaces at their outer edges.

As best seen in FIGS. 8(A) and 8(B), the internal cylindrical surface 802 of casing 800 has a diameter "D", a length "L", and an axis of symmetry Y—Y on which a circular cross-section center "$C_c$" is located. Pump shaft axis X—X is offset or eccentric relative to pump casing axis Y—Y by an eccentricity "e", as best seen in FIG. 8(A).

As best seen in FIGS. 9(A) and 9(B) the air/fuel/lubricant pumping system has a cylindrical rotor 900 having a diameter "d" which is smaller than diameter "D" of the pump casing 800 by at least eccentricity "e" so that the rotor may be rotated about pump shaft axis X—X on which pump rotor center "$C_{pr}$" is located.

In the unique design of rotor 900 according to this invention, at one or both of its ends there is provided a recess 902 in an end surface 904. A similar recess could be provided in the opposite end surface 906, but in FIG. 9(B) only one recess 902 is shown. Rotor 900 is provided with a plurality of diametral grooves 908, each of a constant width and a depth defined at a groove bottom radius "$r_{gb}$" as best seen in FIG. 9(A). Recess 902, regardless of its profile in an axial cross-section, has an outer radius "$r_r$" which is some-what larger than groove bottom radius "$r_{gb}$". This ensures that each groove communicates with each of the other grooves through recess 902. As will be obvious, length "l" of rotor 900 must be slightly smaller than the separation between the respective inner surfaces of casing ends 1300 and 1400 by a tolerance readily fillable by a lubricant so that there is continual lubricated sealing at both ends of rotor 900 when it is fitted into casing 800.

Inside each groove 908, 908, there is slidingly fitted a rectangular vane blade 910.

From considerations of weight, and to reduce the related mass inertia, rotor 900 may preferably be made from aluminum or an aluminum alloy. Vane blades 910, on the other hand, are preferably made of steel or a composite material with smooth surfaces and non-scoring edges and corners. The exact dimensions will, of course, depend upon the particular application for which the engine is being considered. However, conventional tolerances to ensure lubricant-sealed sliding contact at the anticipated operational speeds of relative motion between the moving parts and adjacent contacting portions of casing 800 may be selected in conventional manner.

Figure 12:
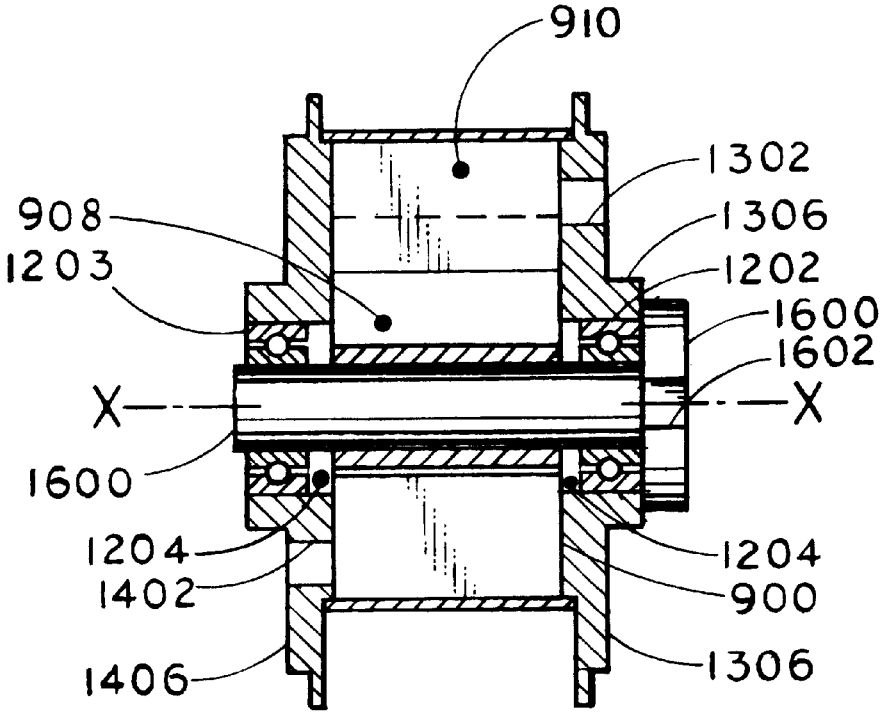
FIG. 12 is a partial axial cross-sectional view of the crankcase charging unit.

The crankcase charging unit must be as light as possible and this is best realized by making it largely of aluminum construction. Housing 800 and vanes 910, 910, which have to be lubricant sealed, are made of steel or a composite material and must be sized so that when they press radially outward to the inside surface of the housing the intervening tolerance is very close. FIG. 12 indicates the proximity of rotor 900 to housing 800 and the end surfaces of cover 1300 and 1400. Hence, because aluminum-to-aluminum contact at high speeds between the rotor and the immediately adjacent covers is totally unacceptable, there is provision for rotor 900 to be axially self-centering. This is accomplished by an axially oriented sliding fit between rotor 900, key 1606, and driven shaft 1600. Expansion and contraction due to extreme uneven temperature changes is thus accommodated with careful sizing and lubrication.

The vanes 910 are preferably made of steel or a composite material and the radial force exerted by each increases rapidly as the "square" of the rotational speed of the engine, therefore the vanes are very thin in order to reduce wear and the energy needed to operate the unit. Since the unit is lubricant sealed, the light vanes cannot overcome the suction created in the lower end of the slots 908.

As will be appreciated from reference to FIG. 8(A), when one of the pump blades 910 moves inwardly into its corresponding slot, it will squeeze out air/fuel/lubricant mixture from the radially innermost portion of its corresponding groove 908 which will then pass through recess 902 into the bottom portions of the other grooves. Whichever blade(s) is present at the intake side of the rotor 900 will experience a suction thereat and will tend to be drawn radially outward. A direct and intentional benefit realized by this scheme is that the air/fuel/lubricant mixture present under pressure in the recess 902 will help to push radially outward whichever blades are moving in the radially outward direction at that time. This gaseous pressure at the bottom edge of that particular pump blade 910, coupled with the centrifugal force acting to draw it radially outward, will cause the outermost edge of the outwardly moving blades, e.g., blade 910, to slidingly and in lubricated manner continually press against the cylindrical inner surface of casing 800 during engine operation. In summary, when one blade slides radially inward in its groove it will displace a gaseous mixture, under pressure, in a manner which will assist all outwardly moving pump blades to move outward very effectively. This entire mechanism requires no additional parts yet, simply by the provision of a central recess 902 at one end, or at both ends if desired, significantly improves the operational efficiency of the vane pump.

As the rotor 900 turns, a suction is created at the intake side of the unit increasing as the vanes approach the intake port. As the vacuum increases the vanes are sucked out of their respective slots and held tight against the housing, also causing a pulsating vacuum and using excess energy. The arcuate opening 1402 connecting two vanes together relieves the build up of vacuum between vanes and eliminates the pulsations, greatly reducing the energy necessary to drive the unit.

The pressure side works oppositely. As the rotor 900 turns, a pressure is built up forcing the vanes inwardly to render them non-operational. The arcuate opening 1302 on the discharge side eliminates a pressure build up between the vanes. Since there are three cylinders accepting fuel at the same time there is now a barely positive crankcase pressure allowing centrifugal force and the pumping action of the other vanes to operate the pressure side.

No known two-cycle engine can operate efficiently with a barely positive crank-case pressure. A means is therefore provided to increase crank-case pressure and distribute the air/oil/lubricant mixture to all the cylinders. As the mixture enters the crank-case, being heavier than air it falls to the bottom of the crank-case, the charging unit is positioned so that the fuel mixture enters at the top of the crank-case. The unique master rod assembly shown in side view of FIG. 5(B), as opposed to the conventional type FIG. 5(C), when placed facing the incoming fuel, acts as a type of blade assembly.

The engine is preferably started with a battery operated electric starter which turns at over 900 r.p.m. to start the engine. The master rod placed in close proximity to the incoming fuel engages the fuel mixture and spins it as if in a centrifuge, providing both even distribution of the fuel mixture and pressure by centrifugal force to the cylinders, with no additional energy requirement. It must be noted that once the engine starts, its idle speed typically is approximately 2,000 r.p.m., and the engine accelerates up to 10,000 r.p.m. thereafter.

Figure 10:
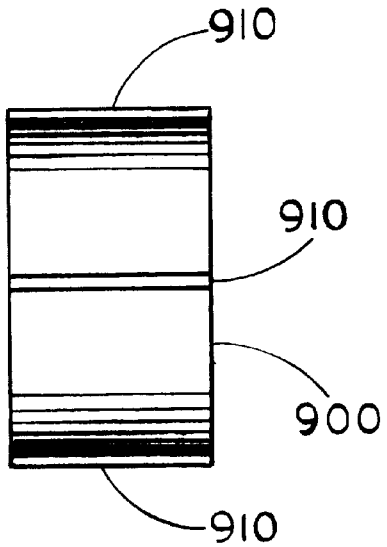
FIG. 10 is a side elevation view of the rotor and blade assembly per FIGS. 9(A) and 9(B).
Figure 11:
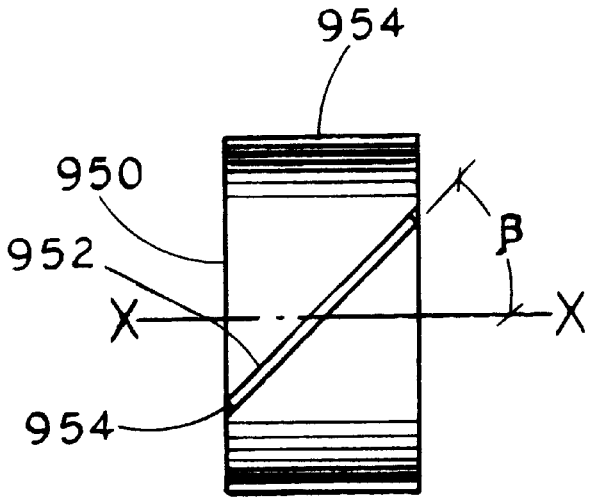
FIG. 11 is a side elevation view of a rotor and blade assembly according to another embodiment which constitutes a variation of the rotor and blade assembly per FIG. 10.

FIG. 11, which should be compared to FIG. 10, relates to another embodiment in which a pump rotor 950 has a plurality of grooves 952 cut radially inward but not lying in a diametral plane. Instead, each groove 952 lies in a plane inclined at an angle "β" relative to the rotor axis of symmetry X—X (the axis is identified as if the rotor were in place in the engine and is the same as the axis of rotation of the crankshaft).

The positioning of the vanes at an angle to the axis increases the cross sectional area to add strength to the vane. This also creates a leading and trailing edge to greatly reduce the tendency of bending the vanes when used on larger engines needing a longer stroke of the vanes.

As best seen in FIG. 12, a partial, axial, cross-sectional view of the air/fuel/lubricant pump 1500 (shown in exploded view in FIG. 15), rotor 900 is irrotatably (e.g., by keying in known manner) supported on a pump shaft 1600 which is itself rotatably supported on a front pump ballbearing 1202. A preferably flexible bearing seal 1204 may be employed between rear ballbearing 1203 and recess 902 of the pump rotor 900. This ensures that air/fuel/lubricant trapped within the bottom portions of grooves 908 under respective vane blades 910 and the space defined between recess 902 and bearing seal 1204 is contained in a pressurized manner during operation of the pump. Front ballbearing 1202 is held in a recess of front pump cover plate 1300 which fits into the front end of casing 800 and is held in place by a plurality of conventional screws or bolts (not shown). A generally similarly shaped cover plate 1400 (see FIG. 13(A) and 14(A)) is provided at the opposite side of casing 800, as best understood with reference to FIG. 15.

FIGS. 13A and 13B and 14(A) and 14(B) respectively show how the front and rear cover plates 1300 and 1400 are provided with similar bolt holes 1300 1400 to to facilitate respective engagement with corresponding ends of pump casing 800. Both cover plates also preferably have similar respective central openings 1302 sized to receive press-fitted ballbearings, e.g., ballbearing 1202 in front cover plate 1300.

Most importantly, front cover plate 1300 is provided with an arcuate compressed mixture outlet opening 1302 located and sized so that a quantity of air/fuel/lubricant compressed between two adjacent vanes slidingly held in pump rotor 900 is delivered therethrough into common crankcase 600 to be available to the various engine cylinders. A similar arcuate air/fuel/lubricant pump inlet opening 1402 is provided approximately diametrally opposite the compressed mixture outlet port 1302 by suitable orientation of the rear cover plate 1400 about axis X—X. Mixture inlet port 1402 is located so as to receive from the carburetor a correctly constituted mixture of ambient air and liquid fuel/lubricant mixture from a container thereof (not shown).

Because of the arcuate opening 1402, the mixture flow from the carburetor starts when a vane reaches top dead center and continues to expand the chamber until it reaches bottom dead center and starts the compression stage, this provides a smooth interruption-free flow.

In the particular embodiment illustrated in FIGS. 13A and 13B and 14(A) and 14(B), both the front and rear pump cover plates 1300, 1400 contain arcuate ports 1302 and 1402, respectively. As will be readily understood, to save on machining costs, which are generally higher for producing arcuate ports than for a series of circular ports on a given circumference, the manufacturer of such multicylinder, radial, two-stroke engine may choose to replace arcuate ports 1302 and 1402 by appropriately dimensioned sets of particular apertures on the same circumference. Such details are considered matters of design choice and are not considered critical to the success of the claimed engine in use. Persons of ordinary skill in the art can be expected to consider such options without departing from the fundamental concept of the improved air/fuel/lubricant pump as disclosed herein.

FIGS. 14A and 14B are side elevation views, respectively, of front and rear cover plates 1300 and 1400. These are relatively simple structures and can be readily machined to the required dimensions and tolerances by conventional equipment. These and other mechanical elements of the engine may advantageously be made of aluminum or an aluminum alloy to reduce the overall weight of the engine for a given power output therefrom. As noted earlier, the exact dimensions of the air/fuel/lubricant pump are matters of design choice, e.g., for a given throughput a pump with a shorter length may be given a larger diameter, and vice versa. It is believed that such engineering considerations are readily understood by persons skilled in the mechanical arts and are not otherwise critical.

FIG. 15 shows the air/fuel/lubricant pump in exploded side elevation view. The various components are as described earlier, and by selected choice of materials, dimensions and tolerances, such a component of the overall engine can be manufactured relatively inexpensively, maintained easily, and should not add significantly to the cost of the engine as a whole.

Figure 16A:
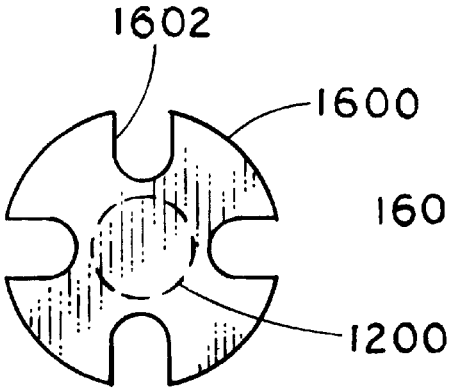
FIGS. 16(A) and 16(B) are an end elevation and an axial view, respectively, of the crankcase charging unit driven shaft.
Figure 16B:
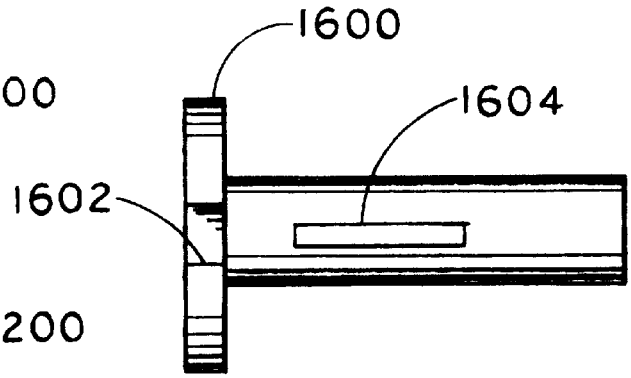
Figure 17:
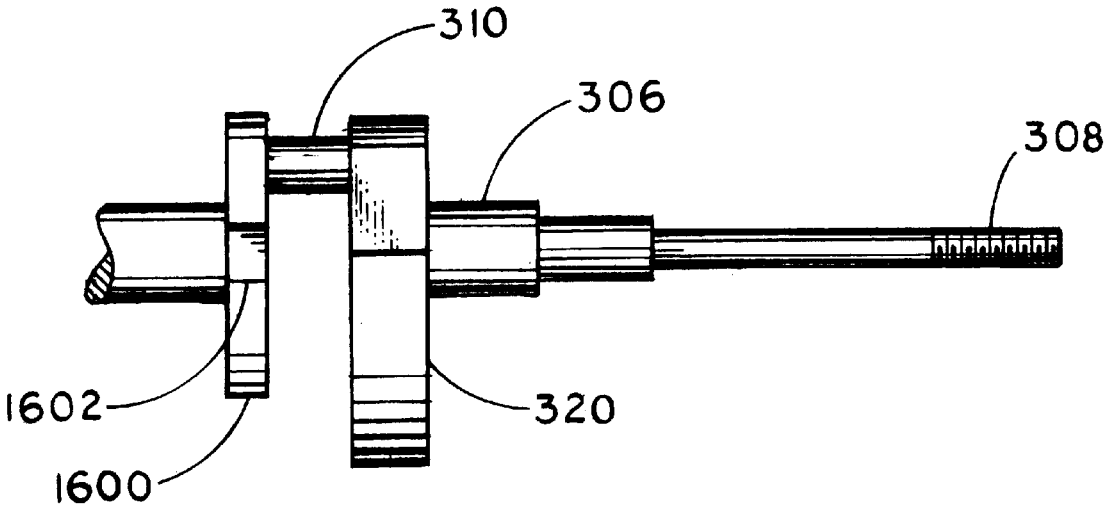
FIG. 17 schematically shows engagement of the crankshaft with the charging unit driven shaft.

FIGS. 16A and 16B are a front end view and a partial side elevation view, respectively, of the pump shaft 1600 on which rotor 900 is mounted by use of a conventional key 1606 located in keyway 1604. The pump shaft 1600 and the circular drive element preferably are of a one-piece construction. At the forwardmost end of pump shaft 1600 there is provided a segmented, preferably generally circular, pump drive element. This element is provided with at least one pair of diametrally opposed, preferably U-shaped, cutouts 1602, 1602. Additional diametrally opposed cutouts may also be provided to reduce the overall weight of the air/fuel/lubricant pump structure. Providing two diametrally opposed cutouts assists in assuring balance of the rotating rotor/shaft/drive element portion of the air/fuel/lubricant pump structure. Each cutout 1602 is sized and dimensioned to closely but unbindingly receive therein crankend 1310, as best seen in FIG. 17 in side elevation view. See also FIG. 3.

Crankshaft 306 is provided with a counterweight portion 320 and, at a rear end surface, is provided a crankend 310 at a suitable radius. The rear surface 322 of counterweight 320 is separated from an adjacent surface of pump drive element 1600 by a distance sufficient to accommodate the master connecting rod structure illustrated in FIGS. 5A and 5B. Crankend 310 passes through the hole 402 of the master connecting rod so that as the plurality of engine cylinders "fire" in sequence during operation the various connecting rods cooperate to apply a torque to crankend 310. This torque serves to rotate the propeller at its forward end 306 while, simultaneously, driving the air/fuel/lubricant pump rotor via crankend 310 to compress the correctly proportioned mixture received from the carburetor to maintain a pressurized flow thereof to the shared crankcase.

Figure 18A:
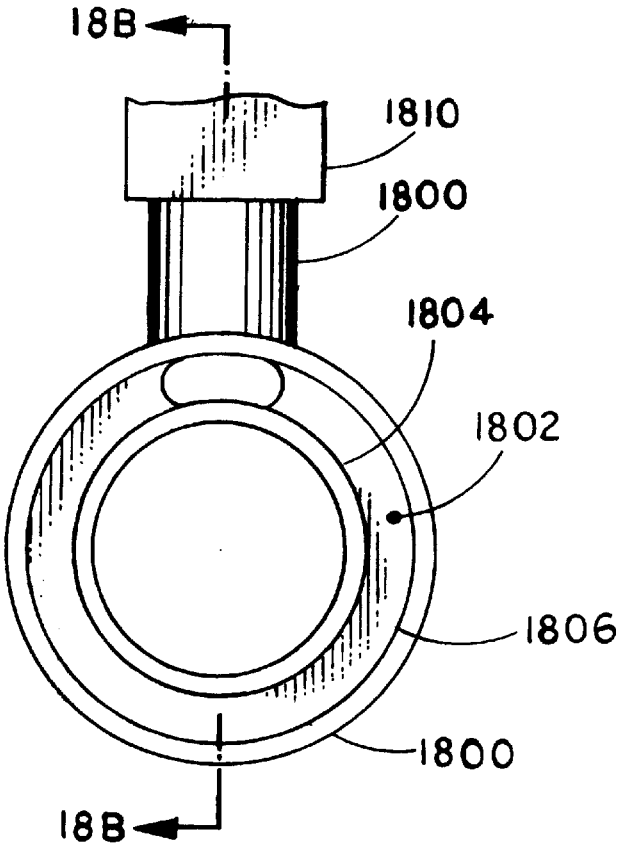
FIGS. 18(A) and 18(B) are rear elevation and cross section (A—A) views, respectively, of an intake manifold peculiar to this engine.
Figure 18B:
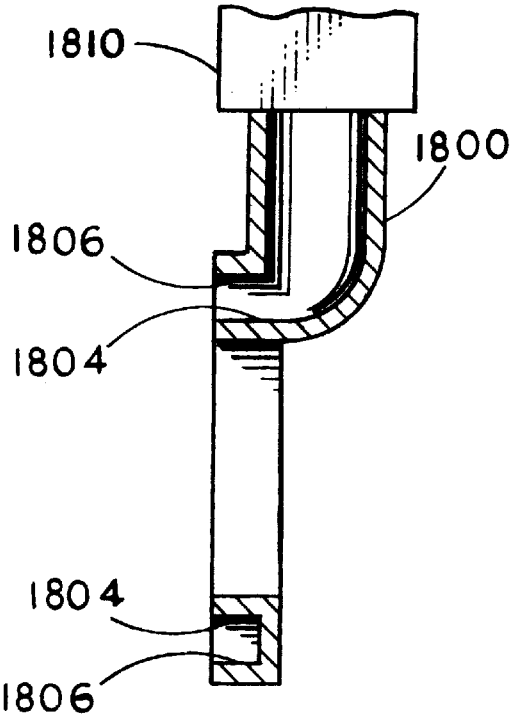

Finally, as best seen in FIGS.18(A)–18(B), at the rear end of the engine assembly is mounted a suitably sized conventional carburetor 1810 which simultaneously draws in a supply of ambient air through carefully calibrated openings in known manner with a controllable supply of a liquid fuel/lubricant mixture from a reservoir thereof (not shown). Carburetor 1810 may be selected for size, throughflow capacity, and suitability otherwise, from a variety of commercially available carburetors and thus is not described in particular detail. The exact make, model, and assorted structural features of the carburetor are not particularly critical, although they must be selected with consideration given to factors such as weight, cost and ease of maintenance.

What is important, as best seen in FIGS. 1 and 18(A)–18(B) is that carburetor 1810 is mounted above annular air/fuel/lubricant conduit 1802 which has an inside circumference 1804 and an outside circumference 1806, the cross-sectional form being U-shaped, i.e., generally similar to that of exhaust collection and muffler element 700. Small bolt holes (not shown for simplicity) are provided in air/fuel/lubricant conduit 1802 to enable it to be fitted to an outer surface of rear pump cover plate 1306. With this arrangement, with the user exercising radio control, the rate at which liquid fuel/lubricant is provided to carburetor 1800 via inlet pipe 1808 is readily adjusted as needed. The carburetor aspirates ambient air through an inlet (not shown) and a downdraft is created through the carburetor body 1810 into the annular space 1802 which communicates with air/fuel/inlet arcuate port 1402 where the carburetor is mounted as described above. It was discovered that communicating the air/fuel/lubricant blend provided by the carburetor in this manner significantly enhances the thorough mixing of the air with the liquid fuel/lubricant before it enters into pump casing 800 as the pump rotor and vane blades therein are operated. Both this air/fuel/lubricant aspiration system and the pump assembly are considered to be unique and singularly efficient for use with a light-in-weight, easy-to-maintain, relatively inexpensive multicylinder, radial, two-stroke engine.

In summary, the above-described structure provides a unique engine which possesses a significant weight-power ratio, is capable of using commercially available fuel/lubricant mixtures (which typically contain castor oil as the lubricant of choice), and can be operated very quietly through use of the above-disclosed exhaust collection/muffler system. It is believed that this engine has many uses which extend beyond those that would normally be contemplated by airplane model enthusiasts. With suitable drive mechanisms such engines may also be useful to power other types of apparatus, e.g., model helicopters, ground effects machines (commonly known as "hovercraft"), and perhaps even small model wind tunnels and the like.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A multicylinder, two-stroke, radial, internal combustion engine, comprising:

a plurality of cylinders, having respective longitudinal axes evenly spaced apart angularly in a single plane perpendicular to a first rotation axis;

a plurality of pistons, reciprocating respectively in said cylinders;

a crank, rotatable about the first rotation axis by a torque applied via a torque input end to deliver an output torque;

a master connecting rod, having a piston end pivotably connected to a first of said pistons and rigidly connected to a crankdrive element provided with a plurality of crank pins;

additional connecting rods, each respectively connected pivotably to a corresponding piston at a respective piston end and also connected pivotably to a respective one of the crank pins of the crankdrive element, and the master connecting rod being formed to have an aperture to receive the torque receiving end of the crankdrive element to rotate the crank about the first rotation axis, whereby sequential power-producing combustion of compressed air/fuel/lubricant charges in said cylinders generates corresponding thrust forces rod to produce said torque, said engine further comprising:

a single shared crankcase, communicating with the intake ports of each of the cylinders to provide a shared common supply of a mixture of air/fuel/lubricant to each of the cylinders;

a carburetor receiving air, a combustible fuel and a lubricant, the carburetor providing a mixture of air/fuel/lubricant to the single shared crankcase; and a vane pump, driven by said crank, for receiving the mixture of air/fuel/lubricant from the carburetor at subatmospheric pressure and delivering the mixture to the shared crankcase at about atmospheric pressure, wherein said vane pump includes an arcuate opening on an intake side and an exhaust side thereof.

2. The engine according to claim 1, wherein said vane pump includes:

a chamber, having an inlet, an outlet, and a cylindrical peripheral surface extending along a first axis between two chamber end surfaces, wherein at least one of the two chamber end surfaces is formed to have a corresponding at least central annular recess having a selected outer radius;

a rotor having a cylindrical rotor peripheral surface extending between two roto end surfaces, supported to be rotatable about a second axis parallel to and offset relative to the first axis by a predetermined eccentricity, the rotor end surfaces each being separated from an adjacent one of the chamber end surfaces by a lubricated end clearance;

a plurality of slots formed to extend inwardly of the rotor peripheral surface to a base located at a base radius relative to the second axis, each slot extending through the two end surfaces of the rotor, wherein the eccentricity and the base radius are selected such that a bottom portion of each of the slots is in constant communication with respective bottom portions of all other slots via the at least one annular recess; and a plurality of blades, formed to fit slidingly in respective slots of the rotor, each blade having edges in lubricated sliding contact with adjacent surfaces of the chamber.

3. The apparatus according to claim 2, wherein:

the blades are formed of smoothly lapped steel and the rotor is formed of a material comprising aluminum.

* * * * *